United States Patent [19]

LaFleur

[11] 4,233,888

[45] Nov. 18, 1980

[54] METHOD OF MAKING A COLLAPSIBLE DRUM-TYPE CONTAINER

[75] Inventor: Arthur E. LaFleur, Manistee, Mich.

[73] Assignee: Custom Packaging Systems, Manistee, Mich.

[21] Appl. No.: 958,130

[22] Filed: Nov. 6, 1978

[51] Int. Cl.[3] ..... B31B 31/60; B31B 1/26

[52] U.S. Cl. ..... 493/132; 493/160; 493/177

[58] Field of Search ..... 93/355 B, 35 R, 32, 93/31; 229/57, 58, 61, 41 B

[56] References Cited

U.S. PATENT DOCUMENTS

| | | | |
|---|---|---|---|
| 378,487 | 2/1888 | Appel | 229/61 |
| 414,679 | 11/1889 | Claussen | 229/60 |
| 1,995,286 | 3/1935 | Arzet | 229/58 |
| 2,771,010 | 11/1956 | Piazze | 93/35 R |
| 2,865,768 | 12/1958 | Barnes et al. | 229/41 B X |
| 4,094,457 | 6/1978 | Spillson | 229/61 X |

*Primary Examiner*—Robert D. Baldwin
*Assistant Examiner*—Gus T. Hampilos
*Attorney, Agent, or Firm*—Barnes, Kisselle, Raisch & Choate

[57] ABSTRACT

A collapsible drum-type container is formed by scoring lines on a generally rectangular blank of fiberboard or the like so that the blank can be initially folded along one score line into two flat overlying panels. The longitudinal free edges of the panels are sealed together to form a flattened tube. The flattened tube is then opened and refolded along other score lines to provide a flat envelope having an upper open end and a closed lower end defined by an inwardly folded gusset panel between the two side walls of the refolded flattened tube.

11 Claims, 13 Drawing Figures

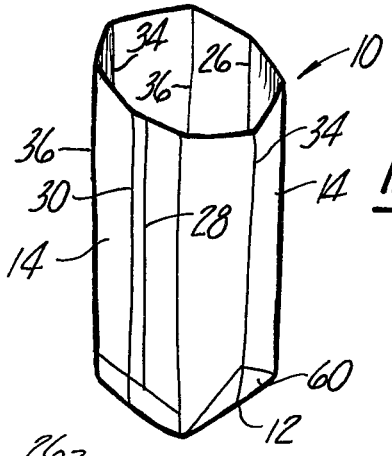
Fig-1
Fig-2
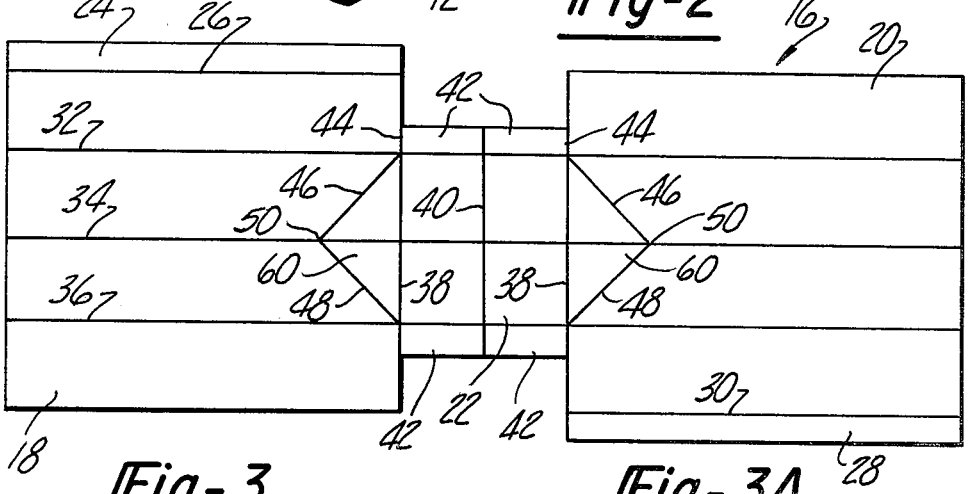
Fig-3
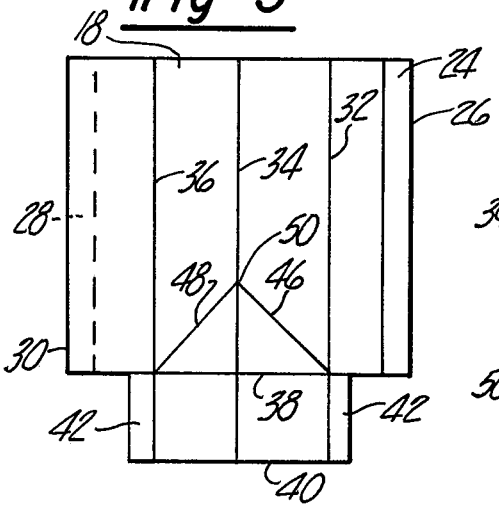
Fig-3A
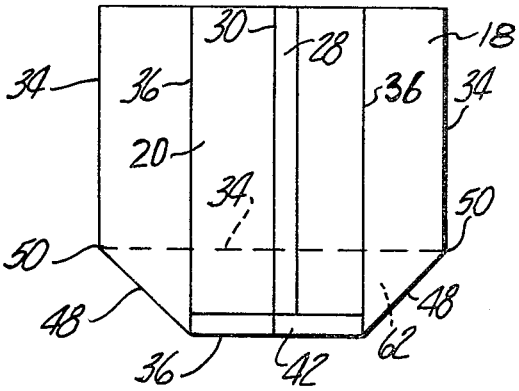

Fig-6
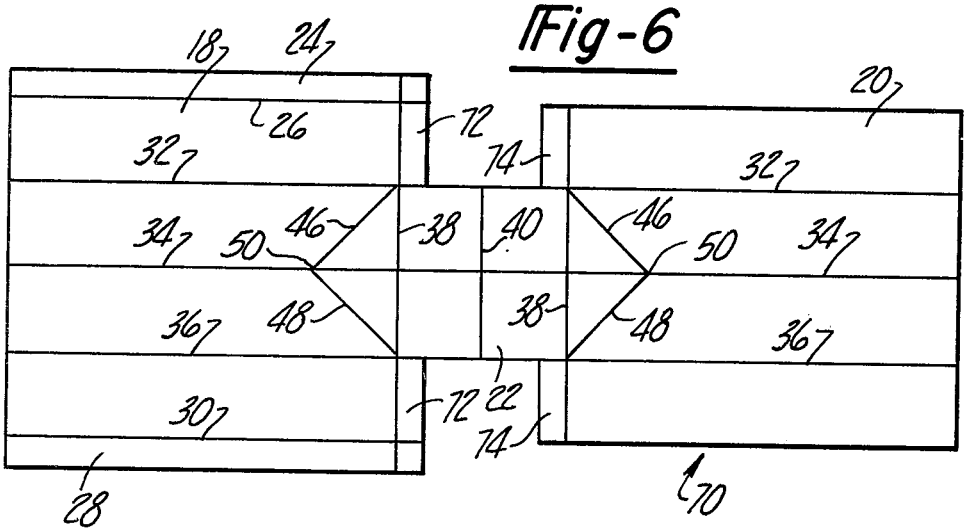
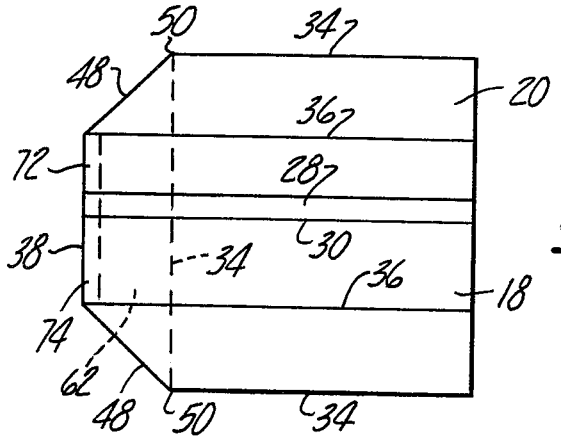
Fig-7
Fig-8
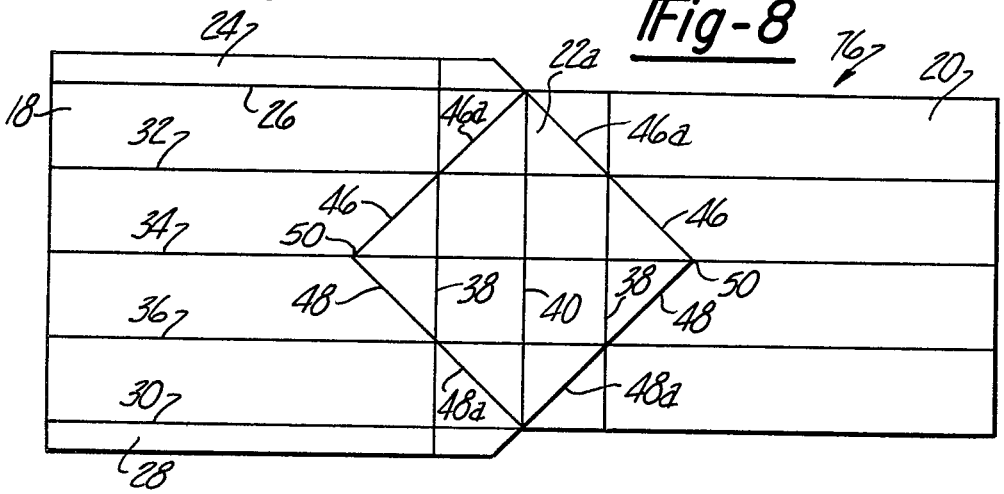

Fig-9
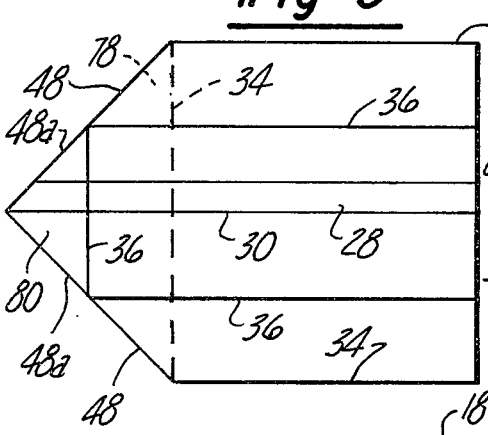
Fig-9A
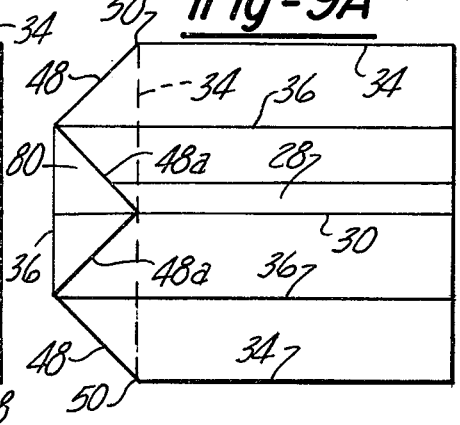
Fig-10
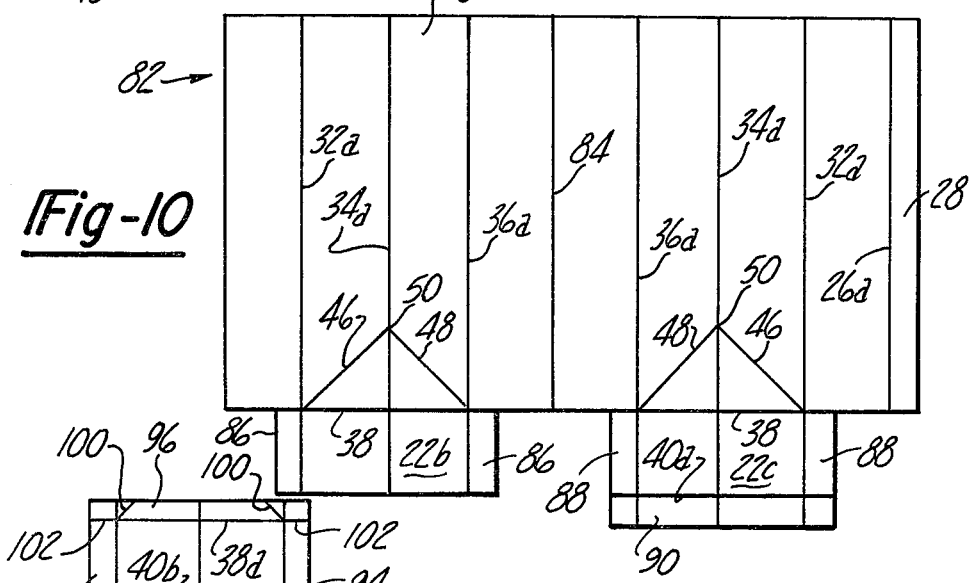
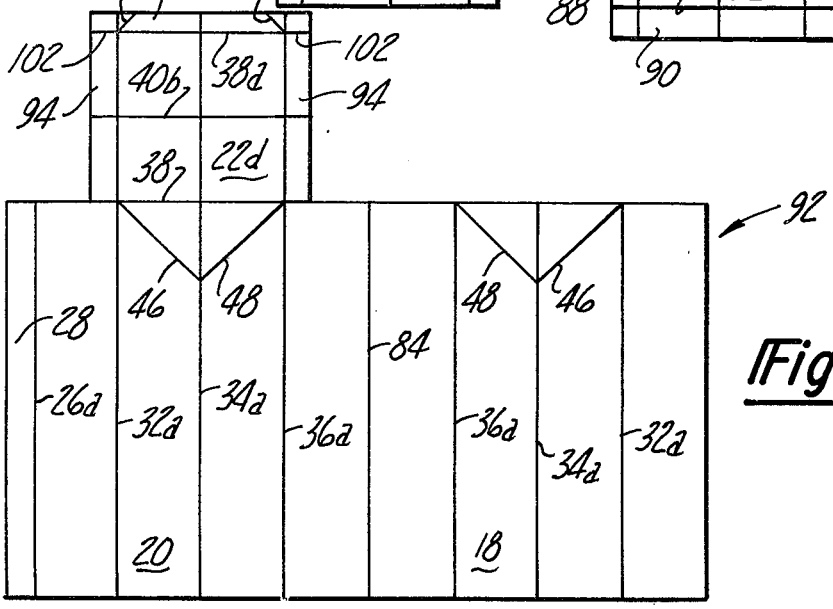
Fig-11

METHOD OF MAKING A COLLAPSIBLE DRUM-TYPE CONTAINER

This invention relates to collapsible drum-type containers made of a relatively heavy foldable material such as fiberboard or the like.

Containers of the above described type are especially adapted for containing asphalt. Such containers are frequently assembled from blanks at the location where they are filled with hot liquid asphalt. The necessity of forming the containers at the site where they are filled results from the fact that heretofore an economical and functionally satisfactory asphalt container has not been produced which can be collapsed into a flat compact unit so that it can be shipped in a flattened condition from a container manufacturing location to a remotely located asphalt filling station where it can be simply opened and filled with asphalt. Obviously, it is not economically practical to ship empty containers in an erected or a set-up condition from a manufacturing source to a remotely located asphalt manufacturing facility. As a consequence, a supply of flat container blanks is normally located closely adjacent an asphalt filling site where they are assembled and completely set up into a drum-type container immediately prior to filling them with asphalt. Normally it is inconvenient and impractical to provide the necessary equipment for converting the blanks into drum-type containers directly adjacent the asphalt filling site.

One attempt to solve this problem is presented in U.S. Pat. No. 4,094,457. The container disclosed in this patent is adapted to be shipped to the asphalt filling station in a folded flat condition, but, before being filled and after the container is opened, a further assembly operation is required to produce the finished container ready for filling. The container is initially formed such that, when the flat folded unit is opened and erected to form the drum-type container, the lower corners of the flat unit assume the form of a pair of depending triangular panels. The additional assembly operation comprises either stapling or adhesively securing these triangular panels to the bottom wall of the container after it is opened. Obviously, this additional operation must be performed directly adjacent the filling site preparatory to filling the container with asphalt.

The primary object of this invention is to provide a collapsible drum-type container that can be shipped as a flat compact unit and erected for use at the filling site by merely opening the collapsed container.

A further object of this invention is to provide a collapsible container of the type described designed to be manufactured economically at a high production rate on generally conventional, or at least relatively uncomplicated, container manufacturing equipment.

Another object of the invention is to provide a collapsible container adapted to be easily set up or erected for filling and which is very stable when in the erected empty or filled condition.

A more specific object of this invention is to provide a container of the type previously described which, in the collapsed shipping condition, comprises a flattened tube closed at its lower end by an inwardly folded gusset panel and adapted to be erected for filling by simply opening the tube and pushing outwardly on the inwardly folded gusset panel which then forms the flat bottom wall of the container.

Other objects, features and advantages of the present invention will become apparent from the following description and accompanying drawings, in which:

FIG. 1 is a perspective view of a container according to the present invention in its open erected condition;

FIG. 2 is a plan view of a blank adapted to be used for forming the container shown in FIG. 1;

FIG. 3 shows the blank of FIG. 2 in its initially folded and partially sealed condition;

FIG. 3A is a plan view of the folded blank of FIG. 3 refolded, completely sealed, and formed into the finished collapsed container;

FIG. 6 is a plan view of another form of blank;

FIG. 7 is a plan view of the finished collapsed container formed from the blank shown in FIG. 6;

FIG. 8 is a plan view of still another form of blank;

FIG. 9 is a view of the blank shown in FIG. 8 folded and sealed into a partially formed container;

FIG. 9A shows the container of FIG. 9 completely formed; and

FIGS. 10 and 11 are plan views of still further forms of blanks adapted for forming the container of this invention.

Figure 4:
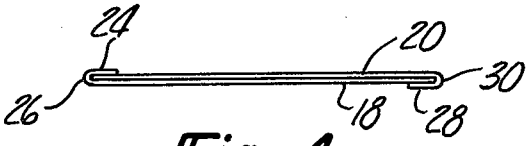
FIG. 4 shows the folded blank of FIG. 3 as viewed from the upper end thereof.

The collapsible drum-type container designated 10 in FIG. 1 has a generally rectangularly-shaped flat bottom wall 12 and side walls 14 extending upwardly from the periphery of the bottom wall 12. This container is adapted to be formed from various shaped blanks. Although the blanks may vary somewhat in configuration, all of the blanks are of generally rectangular shape and possess common features characteristic of the finished container. The blank 16 shown in FIG. 2 comprises two flat panels 18,20 connected by a narrow central panel 22. Panel 18 has a side sealing flap 24 connected to the panel by a fold line 26 and panel 20 has a similar sealing flap 28 connected to the panel by a fold line 30. Each panel has three longitudinally extending score lines 32,34,36 extending throughout the length thereof and across the connecting panel 22. Score line 34 extends continuously along the panels midway between the opposite side edges thereof. If the bottom wall of the container is in the form of a square, then score lines 32,36 are located midway between the central score line 34 and the opposite side edges of the panels. The central interconnecting panel 22 has score lines 38 at opposite sides thereof along its lines of junction with panels 18 and 20. The central panel 22 is also provided with a central score line 40. The score lines 32,36 define on the central panel 22 fold lines for two individual sealing tabs 42. Tabs 42 are individual in the sense that the short edges 44 thereof are severed rather than being merely scored.

One of the distinguishing features of the blanks utilized for forming the container of this invention comprises a pair of converging score lines 46,48 on each of the panels 18,20. The score lines 46,48 are symmetrical about the central score line 34. Each score line 46 extends from the intersection of score lines 32 and 38 to the central score line 34 and each score line 48 extends from the intersection of score lines 36 and 38 to the central score line 34. Score lines 34,46,48 intersect at a common point 50.

In forming the container, the blank 16 is first folded along the central score line 40 of connecting panel 22 so that the two panels 18,20 overlie one another, with the score lines preferably on the inner side thereof. The sealing flaps 24,28 are then folded along the fold lines 26,30 and sealed to the adjacent panel as illustrated in FIGS. 3 and 4. These sealing operations can be performed on conventional folding and sealing apparatus while the blank is being moved in a lengthwise direction. In order to form the folded blank of FIG. 3 into the finished flattened container of FIG. 3A, the successive steps shown in FIG. 5 are performed on the blank.

Figure 5:
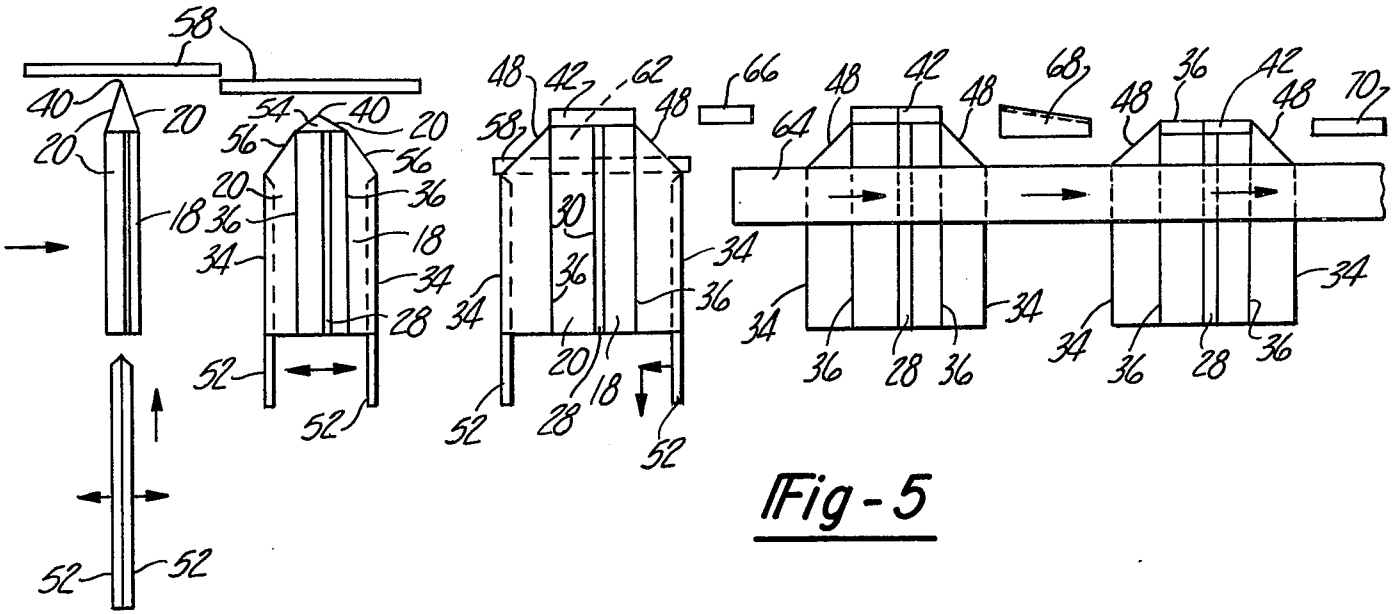
FIG. 5 is a schematic view showing the successive steps in forming the blank of FIG. 3 into the finished container shown in FIG. 3A.

The first step illustrated in FIG. 5 comprises inserting a pair of spreader bars 52 into the open end of the folded blank shown in FIG. 3. Thereafter the two spreader bars 52 are spread laterally apart in a plane perpendicular to the plane of the folded blank to engage the two panels 18,20 at the central score line 34 thereof. As the spreader bars 52 are moved laterally apart, the connecting panel 22 initially assumes the form of an endwise open triangular cap 54 and the two triangular panel sections 60 bounded by score lines 46,48,38 begin to converge inwardly toward each other as indicated at 56. At this stage of the assembly a gusseting bar 58 extending transversely of the container adjacent the closed end thereof is displaced toward the container in the plane of the central score line 34 which is now generally U-shaped. As the spreader bars 52 continue to spread apart, the gusseting bar 58 is displaced further inwardly of the refolded blank along the plane of the central score line 34 so that the two triangular sections 60 of each panel 18,20 and the connecting panel 22 are progressively folded inwardly to form an inwardly folded gusset panel 62 and the two panels 18,20 are progressively refolded along the U-shaped score line 34 to a generally flattened condition.

Thereafter the two spreader bars 52 are moved inwardly toward each other and then withdrawn from within the refolded blank and the blank is then displaced laterally (to the right as shown in FIG. 5) by a suitable conveyor 64. As the refolded blank is displaced laterally the two sealing tabs 42 are each contacted by an adhesive wheel 66 for applying adhesive thereto. Thereafter, the adhesively coated tabs 42 are folded inwardly by a former 68 and then contacted by a pressure roller 70 to adhesively secure them to the outer faces of adjacent panel sections 18,20 and thereby provide the flattened container illustrated in FIG. 3A. Thus, after the blank 16 is folded into the form shown in FIG. 3, all the subsequent operations necessary for refolding and sealing the container can be performed while the container is moving laterally.

The operations in FIG. 5 are shown schematically. The orientation of the container and the devices performing operations thereon can be other than shown. If the closed end of the container is considered to be its lower end, then the gusseting bar 58 can be considered as being displaced upwardly relative to the lower end of the container to form the folded gusset panel 62. The terms "upper" and "lower" as used herein are intended to indicate directions relative to the container having a closed lower end.

The finished collapsed container shown in FIG. 3A has two flat side walls, the longitudinal side edges of which are defined by folds along the portions of score lines 34 extending upwardly beyond the intersecting points 50 on the flat panels 18,20. The lower corners of the finished collapsed container are defined by folds along the converging score lines 46,48. The closed lower ends of the collapsed container are defined by folds along score lines 38 and the folded gusset panel 62 is defined by the two triangular sections 60 and the connecting panel 22. The fold line between the two halves of the gusset panel 62 comprises the portions of score line 34 extending between the intersecting points 50.

A large quantity of finished containers 10 can be shipped in the flattened condition illustrated in FIG. 3A economically from the container-manufacturing source to the asphalt filling location. To erect the container shown in FIG. 3A for filling it with asphalt, it is merely necessary to spread the two side walls thereof slightly apart and push outwardly on the inwardly folded gusset panel 62 at the center fold line 34 thereof. The container will then assume the shape illustrated in FIG. 1, wherein the flat bottom wall thereof comprises the interconnecting panel 22.

The blank 70 shown in FIG. 6 differs only slightly from blank 16 shown in FIG. 2. Like blank 16, blank 70 comprises two flat panels 18,20 connected by a central panel 22 and provided with score lines 32,34,36,38,40,46, 48. On blank 70 sealing flaps 24,28 are formed at the opposite edges of panel 18. Likewise, on blank 70 the sealing tabs 72,74 are formed at the inner free edges of panels 18,20 rather than on the opposite outer sides of central panel 22. As was the case with the previous blank described, blank 70 is initially folded flat upon itself along score line 40 and the two sealing flaps 24, 28 are adhesively secured to the laterally outer edge portions of panel 20. The blank is then refolded in the manner illustrated in FIG. 5 and the sealing tabs 72, 74 are then sealed to the juxtaposed inner surfaces of the folded gusset panel 62. The finished collapsed container formed from blank 70 is illustrated in FIG. 7 and differs in appearance from that shown in FIG. 3A substantially only in that the sealing tabs 72,74 are adherred to the folded gusset panel 62 rather than the outer side walls of the container.

Another form of blank 76 is illustrated in FIG. 8. Like the previous blanks, blank 76 comprises two flat panels 18,20 connected by a central panel **22*a* which extends the full width of panel 20 rather than only between the score lines 32,36. Score lines 46,48 are extended as at 46*a* and 48*a* to the center score line 40 on center panel 22*a*. Blank 76 is initially folded along the score line 40 so that the two panels 18,20 are in overlying relation and the sealing flaps 24,28 are then adhesively secured to the opposite edge portions of panel 20. Thereafter, the folded flattened blank is refolded along the central score line 34 in the manner illustrated in FIG. 5 so as to present the configuration shown in FIG. 9. In this case the two halves of the inner folded gusset panel 78 are of triangular shape rather than a triangular frustrum as in the previously described embodiments. One of the half sections of the folded gusset is defined by the panel section bounded by score line 34 and the converging score lines 48,48*a* and the other half section is defined by the panel section bounded by the score line 34 and score lines 46,46*a*. To complete the formation of the collapsed container the triangular portions 80 (FIG. 9) of the overlying portions of side walls of the container and the folded gusset panel 78 are folded upwardly and outwardly about the score lines 36 and are adherred to the outer faces of the side walls of the container so as to present the finished configuration shown in FIG. 9A**.

The blank 82 shown in FIG. 10 comprises the two panels 18,20 connected lengthwise by a score line 84. The sealing flap 28 is provided along the outer edge of panel 20. Each of the panels 18,20 are provided with a rectangular extension panel 22*b* and 22*c*, respectively. Panel 22*b* has sealing tabs 86 at the opposite side edges thereof connected thereto by score lines 32*a* and 36*a* on panel 18. Likewise, panel 22*c* has sealing tabs 88 connected thereto by the score lines 32*a* and 36*a* on panel 20. In addition, panel 22*c* has a sealing tab along its bottom edge connected thereto by a score line 40*a*.

To form the finished container, blank 82 is initially folded along score line 84 to place panels 18 and 20 in overlying relation and sealing flap 28 is adherred to the outer side edge portion of panel 18. While in this folded condition, sealing tab 90 is also bent over and adhesively secured to the outer side of panel 22*b* along the lower portion thereof. Thereafter, blank 82 is refolded in the manner illustrated in FIG. 5 and the sealing tabs 86,88 are adhesively secured to the outer face of the side walls of the refolded blank so that the finished collapsed container has the appearance the same as shown in FIG. 3A.

The blank 92 shown in FIG. 11 is very similar to the blank shown in FIG. 10 with the exception, however, that a single extension panel 22*d* is formed on panel 20. Panel 22*d* has a central transversely extending score line 40*b* and has sealing tabs 94 along its opposite sides connected thereto by extensions of score lines 32*a* and 36*a*. Extension panel 22 also has a sealing tab 96 along its end edge connected thereby by a score line 38*a*. Sealing tab 96 has diagonal score lines 100 adjacent its opposite ends and is separated from sealing tabs 96 by short severed edges 102.

To form the finished container, blank 92 is first folded along score line 84 so as to place panels 18 and 20 in overlying relation. Sealing flap 28 is then adhesively secured to the outer side edge portion of panel 18. Thereafter, extension panel 22 is folded along the central score line 40*b* and sealing tab 96 is adhesively secured to the outer face of panel 18. The diagonal score lines 100 will then register with the score lines 46,48 on panel 18. Thereafter the blank is refolded in the manner illustrated in FIG. 5 and sealing tabs 94 are adhesively secured to the outer side of the two side walls of the refolded blank to seal the lower end thereof. The finished collapsed container thereby produced has the same configuration as that shown in FIG. 3A with the exception that the end portion of each sealing tab 94 adjacent the severed edge 102 overlaps the adjacent end portion of the previously sealed tab 96.

In each of the embodiments illustrated, the bottom wall of the container is generally square and is bounded by folds at the score lines corresponding to those designated 32,36,38 in FIG. 2. If it is desired to provide a container with a rectangularly-shaped (non-square) bottom wall, the two score lines 32,36, or the corresponding score lines 32*a*,36*a*, on each of the blanks would be equally spaced from the central score line 34 a distance greater than the width end panel section of the two panels 18,20. It therefore follows that the two converging score lines 46,48 would then be inclined to the lower edges of these panels (that is, the edges defined by score lines 38) at an angle less than 45°. The score lines 46,48 will, at all events, converge together on the central score line 34 at the points designated 50 and will also extend to the intersections of score lines 34,36 with the score lines 38. It will also be appreciated that it is not absolutely essential to provide the sealing flaps 24,28 or the short sealing tabs on the central interconnecting panel. All of these edges can be sealed together by tape or other means if so desired.

The container 10, which may be formed from any of the blanks described, has a flat bottom wall with generally flat, upwardly extending, side walls. Once the container is opened by pushing outwardly on the inwardly folded gusset panel at the lower end thereof, it tends to remain open in an erect position. This results from the fact that the side walls do not have horizontally extending fold lines thereon that would tend to cause the container to tilt or collapse. This tendency to remain open can also be attributed to the fact that the vertically extending fold lines on the side walls of the container resulting from the initial folding of the blank and the subsequent refolding thereof causes the panel sections adjoining the fold lines to bulge outwardly rather than inwardly. Obviously, this result is exactly the opposite as is obtained with containers having side walls formed from inwardly folded vertically extending gusset panels.

I claim:

1. The method of making an envelope adapted, when opened, to form a drum-type container having a generally rectangular, flat bottom wall and side walls extending upwardly from the periphery of the bottom wall, comprising, folding a flat blank of self-supporting sheet material upon itself to form a pair of generally overlying flat panels, sealing selected edge portions of said flat panels together to form a flattened tube of generally rectangular shape having an open upper end, generally parallel side edges connected by a fold line and lower edges at the end of said tube opposite said open end which are connected by a fold line, forming a first lengthwise extending score line on each panel throughout the length thereof approximately midway between said side edges, forming on each flat panel a second score line extending transversely of and to said side edges at a location spaced upwardly from said fold line connecting the lower edges of the panels, forming a pair of score lines on each panel which converge upwardly toward each other from points on the second score line spaced equally inwardly from said side edges such that the converging score lines intersect at the first score line, opening the flattened tube by spreading said panels apart, refolding the tube along said first score lines into a refolded flattened tube having a pair of overlying flat side walls and additionally folding the lower portions of said panels upwardly and inwardly along said converging score lines and also along the portions of the first score lines extending below said intersections on each of said panels to form an inwardly folded gusset panel at the lower end of said refolded flattened tube which extends upwardly between the side walls thereof, whereby the upper edge of the folded gusset panel comprises the portions of the first score lines which extend downwardly from said intersections on the initially folded blank and the converging score lines form laterally outwardly and upwardly inclined fold lines connecting the laterally outer edges of the folded gusset panel with the lower corner portions of the flat side walls of the refolded flattened tube.

2. The method called for in claim 1 including the step of forming on each panel a pair of generally parallel score lines extending upwardly from the intersection of said converging score lines with the second score line.

3. The method called for in claim 1 wherein the blank is of generally rectangular shape and is initially folded along a transversely extending center line which forms the fold line connection between said lower edges of the flat panels of the initially flattened tube.

4. The method called for in claim 3 wherein said transverse fold line extends across the full width of the initially flattened tube and said converging score lines extend to the lower corners of the initially flattened tube so that, when the tube is refolded, the folded gusset panel is of triangular shape and has apices centrally located at the lower end of the refolded flattened tube and including the step of folding the triangular panel sections at the lower end of the tube upwardly along said second score lines into coplanar connected engagement with adjacent sections of the reflattened tube.

5. The method called for in claim 4 wherein said upwardly folded triangular panel sections are connected to the opposite side walls of the refolded flattened tube.

6. The method called for in claim 1 including the step of initially forming the flat blank such that laterally outer corners at the lower end of the initially flattened tube are defined by rectangularly shaped cut out sections, one side of each cut out section comprising a sealing tab connected to its adjacent panel section by a fold line, said sealing tabs being located at the lower end of the side walls of the reflattened tube and including the step of folding said tabs upwardly along said last-mentioned fold lines and sealing them after the tube is reflattened to an adjacent portion of the refolded tube so as to close the lower end thereof.

7. The method called for in claim 6 wherein the fold lines of said sealing tab comprise the opposite end portions of the second score lines and the tabs are sealed to the juxtaposed inner surfaces of the folded gusset panel adjacent the lower edges thereof.

8. The method called for in claim 6 wherein the fold lines of said sealing tabs extend downwardly from the lower ends of said converging score lines and the sealing tabs are sealed to the lower edge portions of the side walls of the refolded flattened tube.

9. The method called for in claim 1 wherein said steps of opening the initially formed tube, refolding it and, additionally, folding it to form said gusset panel are performed simultaneously in a progressive manner.

10. The method called for in claim 1 wherein the initially formed tube is opened by applying lateral outward forces to the inner faces of the panels along the portions of the first score lines extending upwardly from said intersections on each panel.

11. The method called for in claim 1 wherein said gusset panel is formed by applying an upward force along the portions of the first score lines extending downwardly from said intersections while the initially formed tube is being opened.

* * * * *